US008888538B2

(12) United States Patent
Regnier

(10) Patent No.: US 8,888,538 B2
(45) Date of Patent: Nov. 18, 2014

(54) MODULAR JACK WITH ENHANCED SHIELDING

(75) Inventor: Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 204 days.

(21) Appl. No.: 13/508,398

(22) PCT Filed: Nov. 8, 2010

(86) PCT No.: PCT/US2010/055838

§ 371 (c)(1),
(2), (4) Date: Sep. 28, 2012

(87) PCT Pub. No.: WO2011/057195

PCT Pub. Date: May 12, 2011

(65) Prior Publication Data

US 2013/0130561 A1 May 23, 2013

Related U.S. Application Data

(60) Provisional application No. 61/258,979, filed on Nov. 6, 2009.

(51) Int. Cl.

| | |
|---|---|
| ***H01R 24/00*** | (2011.01) |
| ***H01R 13/518*** | (2006.01) |
| ***H01R 13/6587*** | (2011.01) |
| ***H01R 12/72*** | (2011.01) |
| *H01R 13/6595* | (2011.01) |
| *H01R 24/64* | (2011.01) |

(52) U.S. Cl.

CPC ..... *H01R 23/005* (2013.01); *H01R 13/518* (2013.01); *H01R 13/6587* (2013.01); *H01R 13/6595* (2013.01); *H01R 24/64* (2013.01); *H01R 12/724* (2013.01)

USPC ..... 439/676; 439/540.1; 439/607.23

(58) Field of Classification Search

CPC ..... H01R 23/025; H01R 23/7073

USPC ..... 439/676, 540.1, 541.5, 607.23, 607.24, 439/607.25, 620.11, 620.17, 620.18, 620.23

See application file for complete search history.

(56) References Cited

U.S. PATENT DOCUMENTS

| | | | | |
|---|---|---|---|---|
| 6,511,348 | B1 * | 1/2003 | Wojtacki et al. | 439/620.18 |
| 6,612,871 | B1 | 9/2003 | Givens | |
| 6,655,988 | B1 | 12/2003 | Simmons et al. | |
| 6,743,047 | B2 | 6/2004 | Korsunsky et al. | |
| 7,153,158 | B1 * | 12/2006 | Lee | 439/541.5 |

(Continued)

FOREIGN PATENT DOCUMENTS

KR 2003-0043743 A 6/2003

OTHER PUBLICATIONS

International Search Report for PCT/US2010/055838.

*Primary Examiner* — Hae Moon Hyeon
(74) *Attorney, Agent, or Firm* — Stephen L. Sheldon

(57) ABSTRACT

An electrical connector includes a dielectric housing having a mating face, a plurality of openings therein configured as pairs of aligned openings and a receptacle for receiving a plurality of internal modules therein. A plurality of electrically conductive contacts are positioned within the housing with a portion of each contact extending into one of the openings for engaging contacts of a mateable connector. At least one conductive inter-module shield is located within the receptacle and extends generally towards the mating face to define a plurality of module receiving cavities.

17 Claims, 14 Drawing Sheets

(56) References Cited

U.S. PATENT DOCUMENTS

| | | | | |
|---|---|---|---|---|
| 7,674,136 | B2 * | 3/2010 | Steinke et al. | 439/676 |
| 8,393,917 | B2 * | 3/2013 | Regnier | 439/485 |
| 2006/0030221 | A1 | 2/2006 | Hyland et al. | |
| 2009/0098766 | A1 * | 4/2009 | Steinke et al. | 439/541.5 |
| 2009/0149043 | A1 * | 6/2009 | Zhang | 439/78 |
| 2009/0253293 | A1 * | 10/2009 | Zhang | 439/541.5 |
| 2011/0053418 | A1 * | 3/2011 | Margulis et al. | 439/620.07 |
| 2012/0280766 | A1 * | 11/2012 | Regnier | 333/185 |
| 2012/0309233 | A1 * | 12/2012 | O'Malley et al. | 439/626 |
| 2012/0315794 | A1 * | 12/2012 | Chen et al. | 439/620.07 |
| 2013/0102203 | A1 * | 4/2013 | O'Malley et al. | 439/701 |

* cited by examiner

MODULAR JACK WITH ENHANCED SHIELDING

CROSS-REFERENCE TO RELATED APPLICATIONS

This patent application is a national phase of PCT Application No. PCT/US2010/055838, filed Nov. 8, 2010, which claims the benefit of U.S. Provisional Patent Application No. 61/258,979, filed Nov. 6, 2009, and which is incorporated herein by reference in its entirety.

BACKGROUND

The disclosure relates generally to modular telecommunications jacks and, more particularly, to a high data rate capable modular jack.

Modular jack ("modjack") receptacle connectors mounted to printed circuit boards ("PCBs") are well known in the telecommunications industry. These connectors are often used for electrical connection between two electrical communication devices. With the ever-increasing operating frequencies and data rates of data and communication systems and the increased levels of encoding used to transmit information, the electrical characteristics of such connectors are of increasing importance. In particular, it is desirable that these modjack connectors do not negatively affect the signals transmitted and where possible, noise is removed from the system. Based on these requirements and desires, various proposals have been made in order to improve modjack connectors used with communication or transmission links.

When used as Ethernet connectors, modjacks generally receive an input signal from one electrical device and then communicate a corresponding output signal to a second device coupled thereto. Magnetic circuitry can be used to provide conditioning and isolation of the signals as they pass from the first device to the second and typically such circuitry uses components such as a transformer and a choke. The transformer often is toroidal in shape and includes primary and secondary windings coupled together and wrapped around a toroid so as to provide magnetic coupling between the primary and secondary wire while ensuring electrical isolation. Chokes are also commonly used to filter out unwanted noise, such as common-mode noise, and can be toroidal ferrite designs used in differential signaling applications. Modjacks having such magnetic circuitry are typically referred to in the trade as magnetic jacks.

As system data rates have increased, improving the isolation between the ports of the magnetic jacks has become desirable in order to permit a corresponding increase in the data rate of signals that pass through the magnetic jacks without being influenced by adjacent magnetic jacks. Crosstalk and electro-magnetic radiation and interference between ports of the magnetic jack can have a significant impact on the performance of the magnetic jack and thus the entire system as system speeds and data rates increase. Improvements in shielding and isolation within the magnetic jack is thus desirable.

SUMMARY

An electrical connector includes a dielectric housing having a mating face, a plurality of openings therein configured as pairs of aligned openings and a receptacle for receiving a plurality of subassembly module therein. A plurality of electrically conductive contacts are positioned within the housing with a portion of each contact extending into one of the openings for engaging contacts of a mateable connector. At least one conductive inter-module shield is located within the receptacle and extends generally towards the mating face to define a plurality of module receiving cavities.

BRIEF DESCRIPTION OF THE DRAWINGS

Various other objects, features and attendant advantages will become more fully appreciated as the same becomes better understood when considered in conjunction with the accompanying drawings in which like reference characters designate the same or similar parts throughout the several views, and in which:

FIG. 1 is a front perspective view of a multiport magnetic jack assembly in accordance with a first embodiment;

DETAILED DESCRIPTION OF THE ILLUSTRATED EMBODIMENTS

Figure 7:
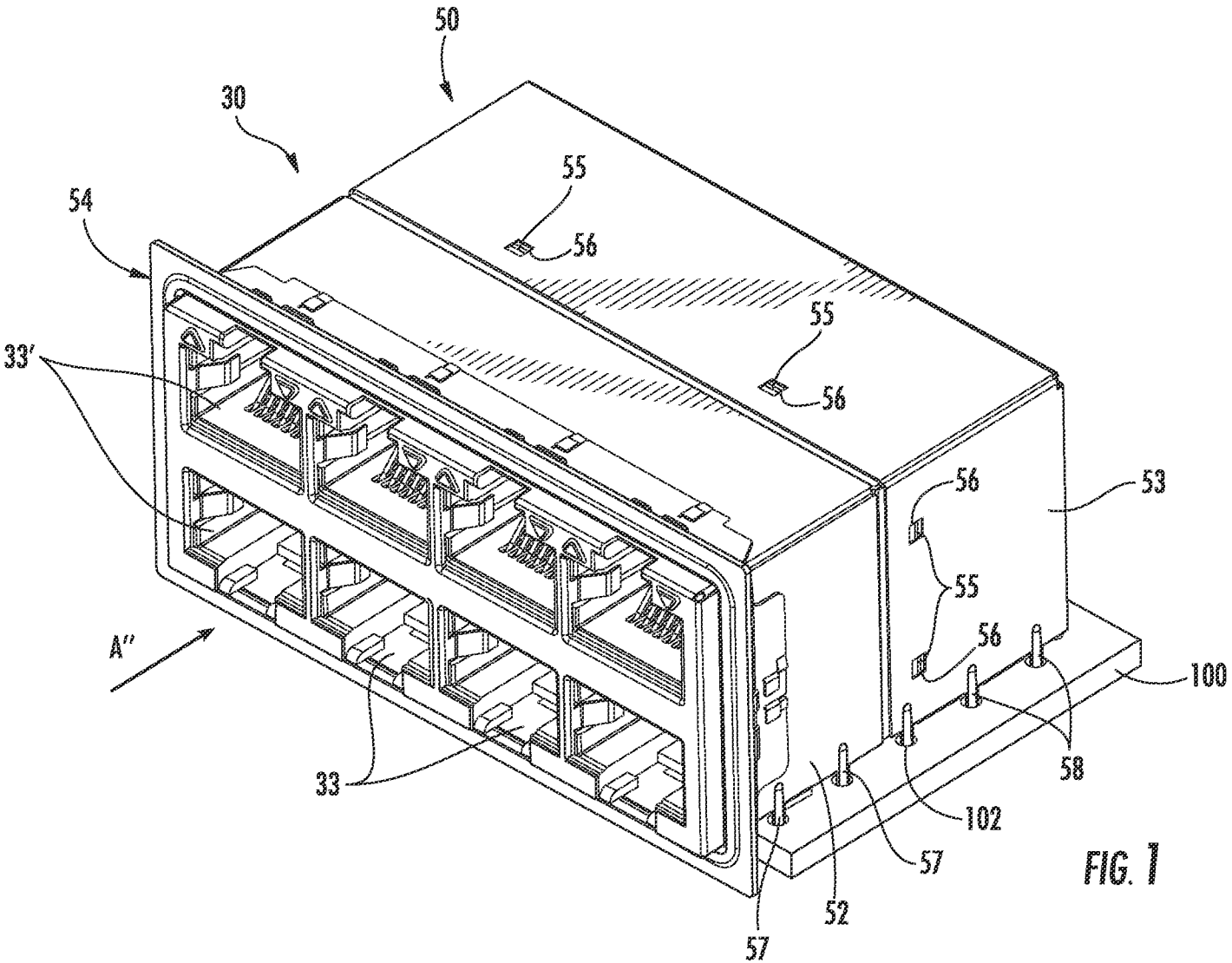
FIG. 7 is a front perspective view of the magnetic jack assembly of FIG. 1 with the outer housing removed for clarity.

The following description is intended to convey the operation of exemplary embodiments to those skilled in the art. It will be appreciated that this description is intended to aid the reader, not to limit the invention. As such, references to a feature or aspect are intended to describe a feature or aspect of an embodiment, not to imply that every embodiment must have the described characteristic. Furthermore, it should be noted that the depicted detailed description illustrates a number of features. While certain features have been combined together to illustrate potential system designs, those features may also be used in other combinations not expressly disclosed. Thus, the depicted combinations are not intended to be limiting unless otherwise noted.

FIG. 1 illustrates the front side of a multiple input, magnetic, stacked jack 30 having a housing 32 made of an insulating material such as a synthetic resin (for example, PBT) and includes front side openings or ports 33 arranged in vertically aligned pairs 33' with each port configured to receive an Ethernet or RJ-45 type jack (not shown). The magnetic jack 30 is configured to be mounted on circuit board 100. A metal or other conductive shield assembly 50 surrounds the magnetic jack housing 32 for radio frequency(RF) and electromagnetic interference (EMI) shielding purposes as well as for providing a ground reference.

It should be noted that in this description, representations of directions such as up, down, left, right, front, rear, and the like, used for explaining the structure and movement of each part of the disclosed embodiment are not intended to be absolute, but rather are relative. These representations are appropriate when each part of the disclosed embodiment is in the position shown in the figures. If the position or frame of reference of the disclosed embodiment changes, however, these representations are to be changed according to the change in the position or frame of reference of the disclosed embodiment.

Shield assembly 50 fully encloses housing 32 except for openings aligned with ports 33 and the bottom or lower surface of the housing and includes a front shield component 52 and a rear shield component 53. Additional shielding components 54 are positioned adjacent and generally surround ports 33 to complete shield assembly 50. The joinable front and rear shield components are formed with interlocking tabs 55 and openings 56 for engaging and securing the components together when the shield assembly 50 is placed into position around the magnetic jack housing 32. Each of the shield components 52, 53 includes ground pegs 57, 58, respectively, that extend into ground through-holes 102 in the circuit board 100 when mounted thereon.

Figure 4:
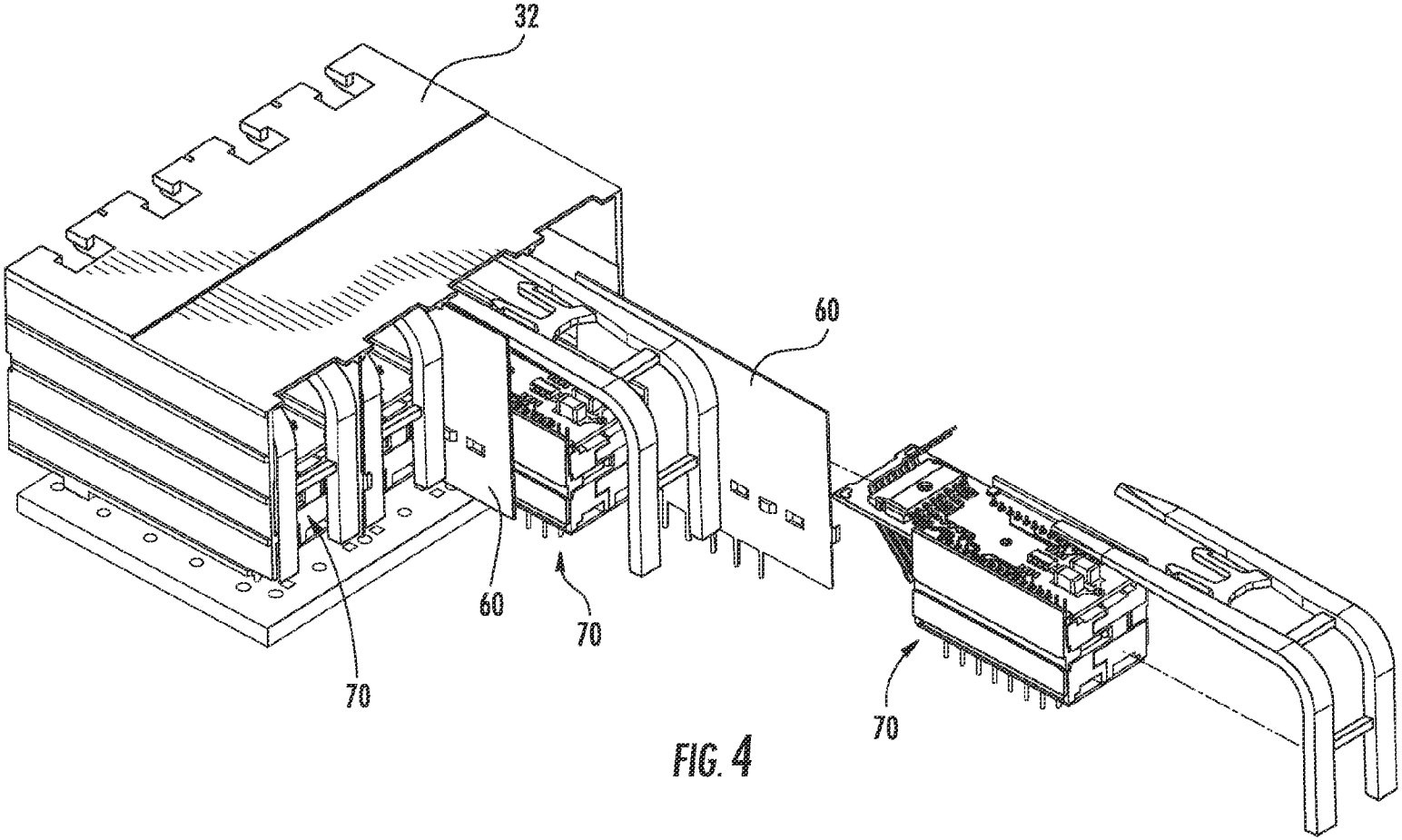
FIG. 4 is a partially exploded rear perspective view of the magnetic jack assembly of FIG. 1 with the internal subassembly modules and inter-module shields in various stages of insertion within the housing and with the outer shielding removed for clarity.
Figure 5:
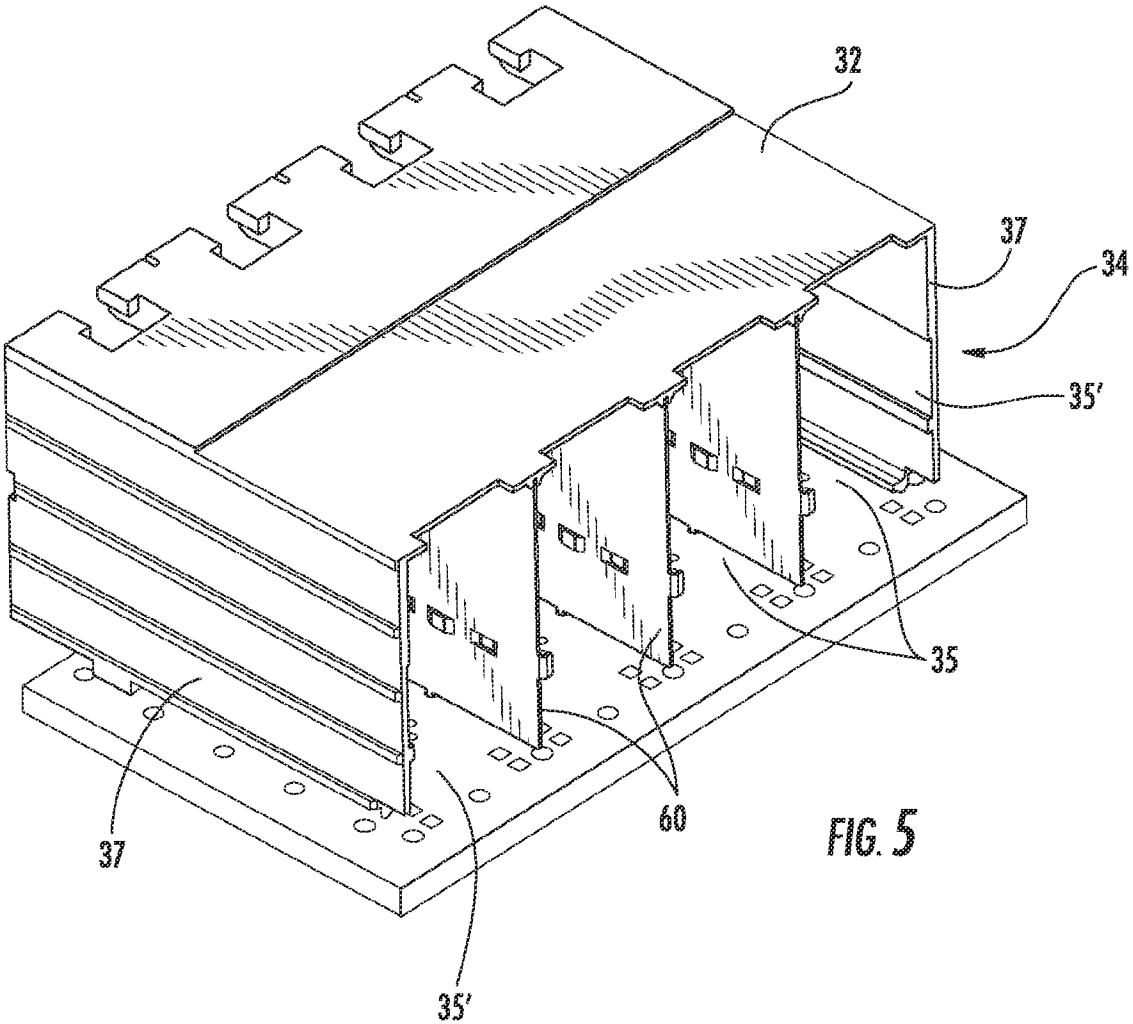
FIG. 5 is a rear perspective view similar to FIG. 4 but with each of the internal subassembly modules removed and the inter-module shields fully inserted.
Figure 6:
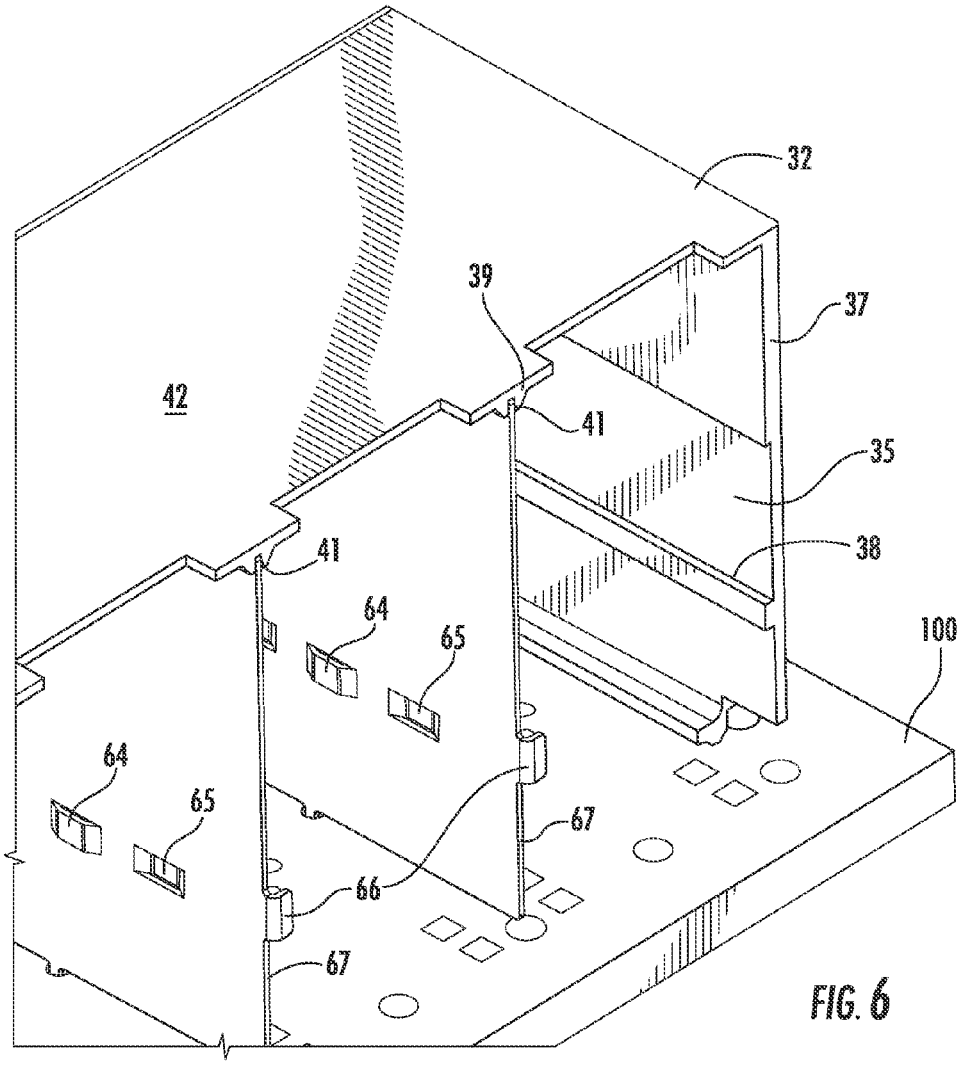
FIG. 6 is an enlarged fragmented perspective view of a portion of FIG. 5.
Figure 7:
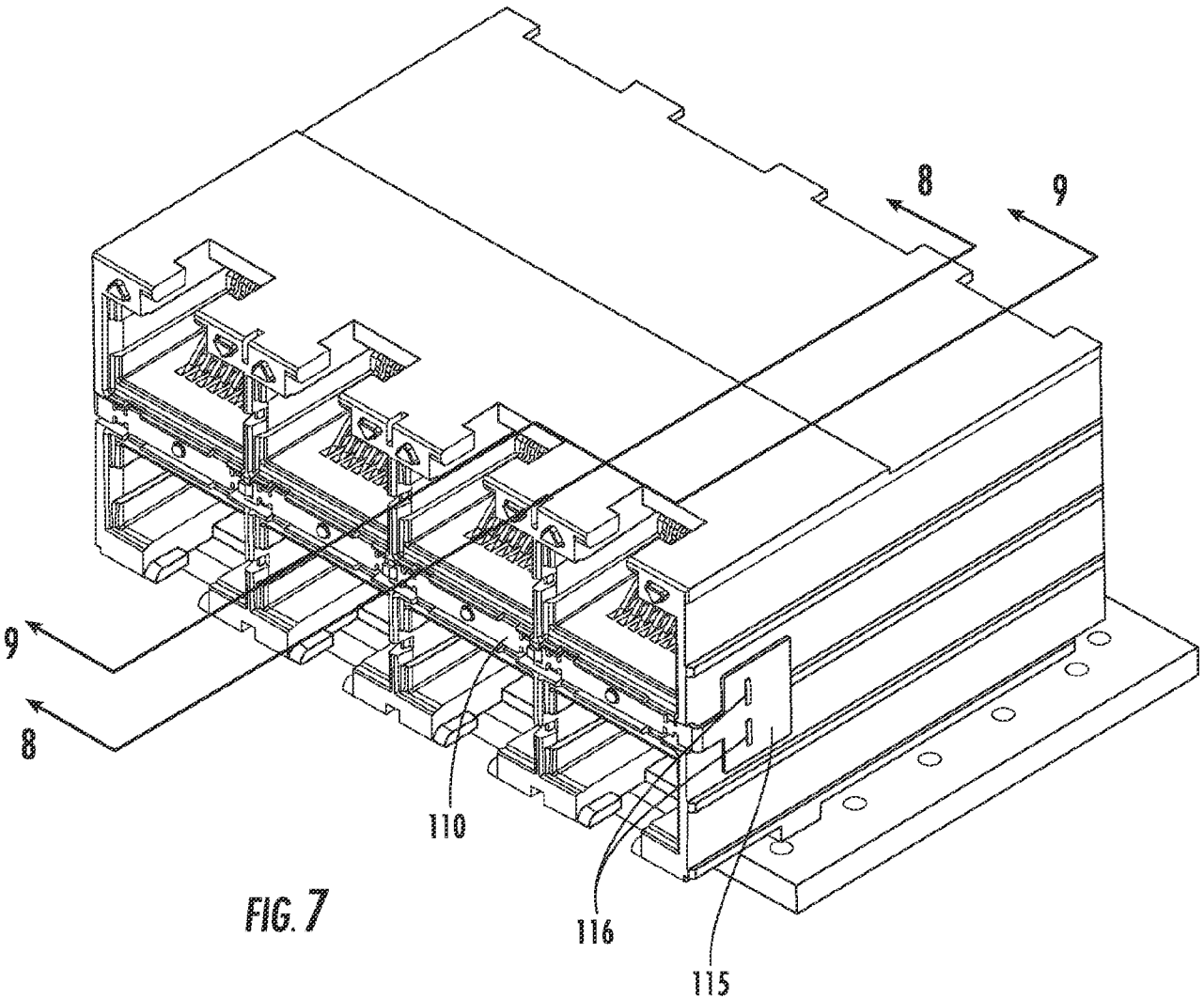

As depicted in FIGS. 4-6, the rear portion of the magnetic jack housing 32 includes a large opening or receptacle 34 with three evenly spaced metal inter-module shields 60 positioned therein to define four subassembly receiving cavities 35. Each cavity 35 is sized and shaped to receive an internal subassembly module 70. While three inter-module shields 60 are depicted, a different number of shields may be used to define a different number of cavities. More specifically, to provide vertical electrical isolation or shielding between each module 70, one shield fewer in number than the desired number of modules is utilized. Shield 60 as depicted is stamped and formed of sheet metal material but could be formed of other conductive material such as die cast metal or plated plastic material.

Figure 8:
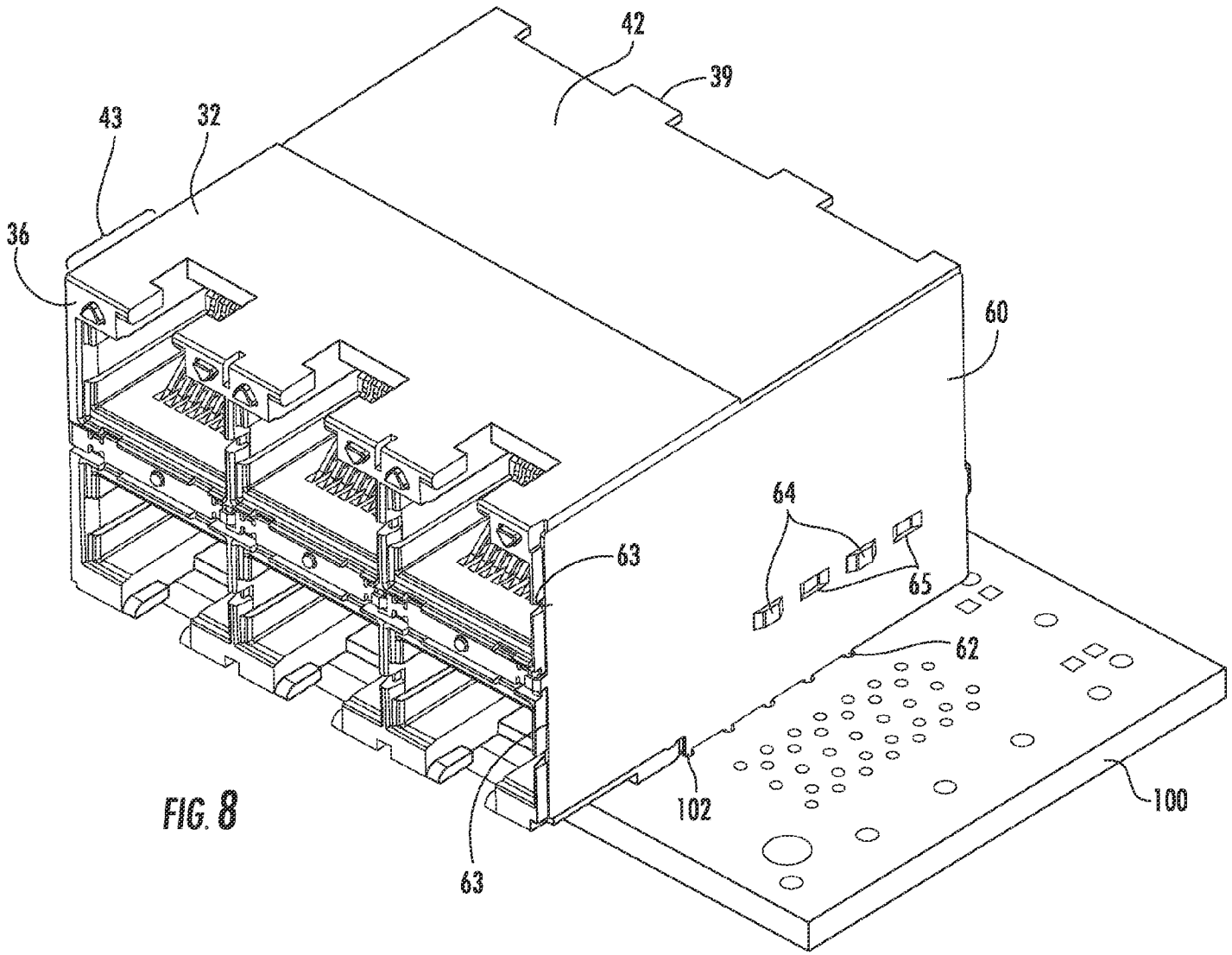
FIG. 8 is a fragmented front perspective view of the housing taken generally along line 8-8 of FIG. 7.

As best seen in FIG. 8, each inter-module shield 60 is a generally rectangular, planar member and includes a plurality of spaced apart tails 62 for insertion into ground through-holes 102 in circuit board 100. The leading or front edge 63 of inter-module shield 60 extends the full height of housing 32 (from the lower surface of the housing to the top wall 42) and to a location generally adjacent the front face 36 of housing 32. In addition, the rear surface of inter-module shield 60 extends to the rear face 39 of housing 32, the upper surface of inter-module shield 60 extends to the top wall 42 of housing 32 and the lower surface of inter-module shield 60 extends downward so as to be generally in line with the lower edges of sidewalls 37 of housing 32 and generally adjacent circuit board 100 upon mounting the magnetic jack 30 on circuit board 100. Accordingly, inter-module shield 60 extends the full depth of magnetic jack 30 in the insertion direction "A" (FIG. 1) of the Ethernet plugs (not shown) that are inserted into ports 33 as well as the full height (perpendicular to direction "A") of the magnetic jack. Thus, the shield creates a vertical barrier to isolate one pair of vertically aligned ports and their internal subassembly module 70 from a pair of adjacent aligned ports and the internal subassembly modules associated with such adjacent ports.

While shields 60 extend essentially the full depth of ports 36 (in the insertion direction) in order to create the vertical barrier between vertically aligned ports, in some circumstances, it may be possible for the shields 60 to extend only partway to the front face 36 (e.g., extending only 50% of the way between a rear surface of port 33 and front face 36) while still providing sufficient shielding. This may be desirable, for example, in situations in which it is difficult to mold the necessary slots 44 that extend to the front face 36 of housing 32.

Each inter-module shield 60 includes two pairs of guide projections 64, 65 that extend in opposite directions into cavities 35 in order to guide and provide support to subassembly modules 70. More specifically, each inter-module shield 60 includes a first pair of guide tabs 64 that are sheared, drawn and formed out of the shield and extend in a first direction (to the left as seen in FIG. 6) and a second pair of guide projections 65 formed in a similar manner and extending in an opposite direction (to the right as viewed in FIG. 6). Together, the guide projections 64, 65 of the pairs of inter-module shields 60 define guide rails that are dimensioned to engage a channel 72 on each side of subassembly module 70. Each cavity 35 (defined by a pair of inter-module shields 60) includes guide rails defined by projections 64 on one side of the cavity and projections 65 across cavity 35 on the other side of the cavity. The two outer cavities 35' that are defined by the side walls 37 of housing 32 and one of the module shields 60 have a first guide rail defined by the guide projection of the module shield and a second guide rail defined by projection 38 extending along the inside of side wall 37 of housing 32. As a result, the subassembly modules 70 are supported on both sides within housing 32 regardless of whether the sides of the cavities 35 are defined by a pair of inter-module shields 60 or a single inter-module shield 60 and a side wall 37 of housing 32.

Figure 9:
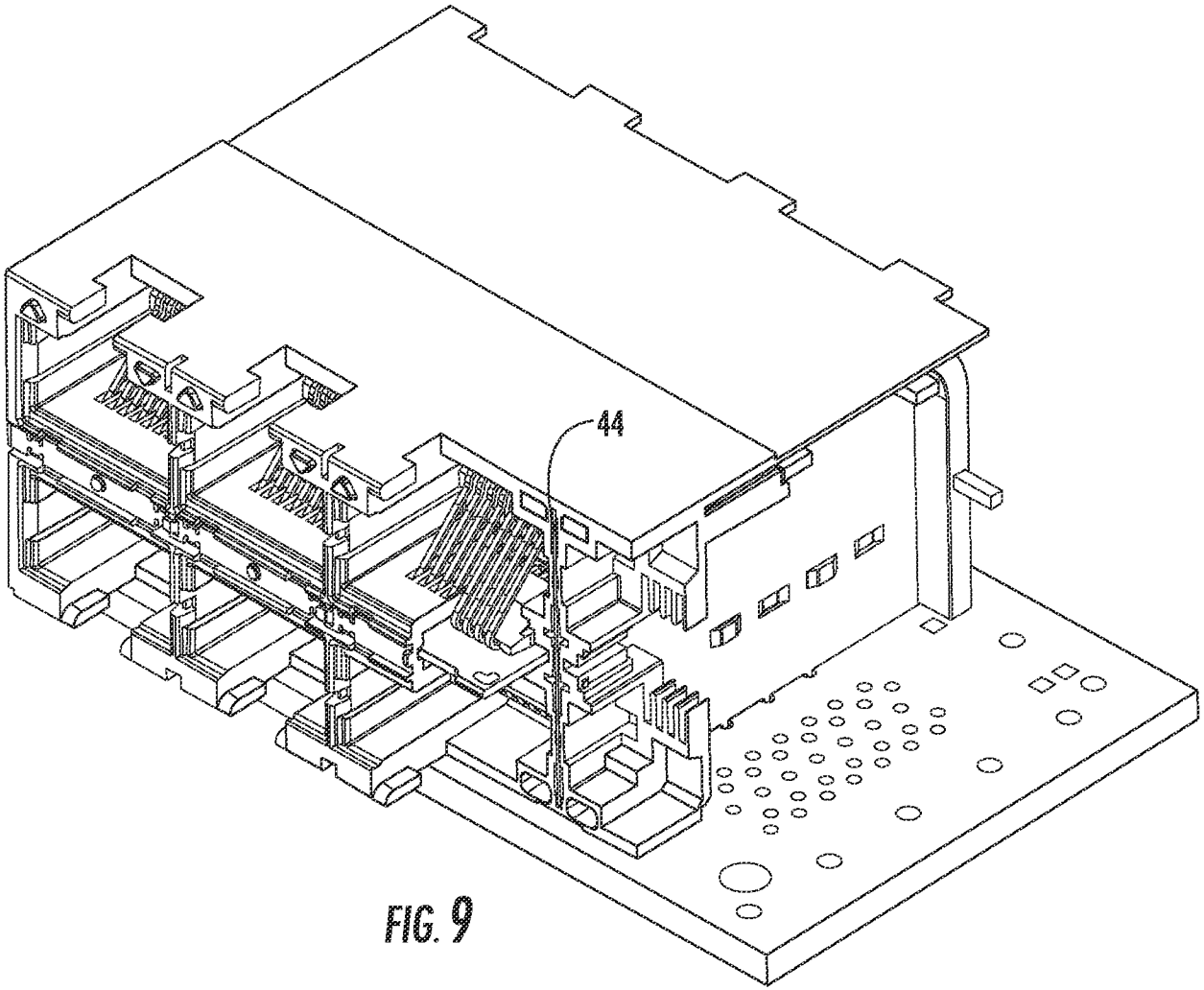
FIG. 9 is a fragmented front perspective view taken generally along line 9-9 of FIG. 7 but with the circuit board and connector of the internal subassembly module un-sectioned for clarity.

As depicted, inter-module shields 60 are inserted from the rear face or surface 39 of housing 32 and are received in slots or channels 41 (FIG. 6) that extend along the inner surface of top wall 42 of housing 32 in a direction generally parallel to the insertion direction "A" of the Ethernet or RJ-45 type plugs. The front portion 43 of housing 32 at which the ports 33 are located includes vertical slots 44 (FIGS. 7-9) into which the leading edge 63 of inter-module shield 60 is inserted in order to permit the leading edge 63 of module shield 60 to extend to or almost to the front face 36 of housing 32 in order to provide vertical shielding between vertical pairs of ports 33'. In other words, vertical shielding is provided by inter-module shields 60 from adjacent the rear face 39 of housing 32 to adjacent the front face 36 of housing 32.

Figure 3:
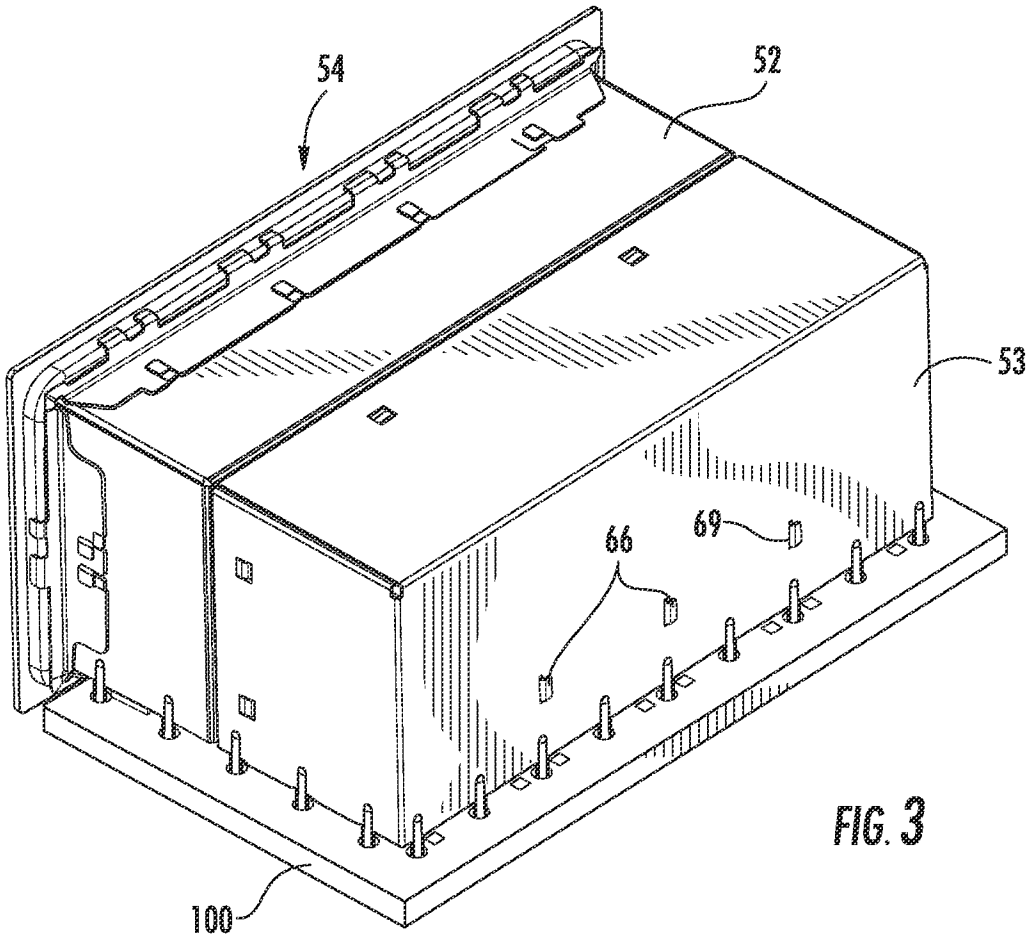
FIG. 3 is a is a rear perspective view of the magnetic jack assembly of FIG. 1.
Figure 10:
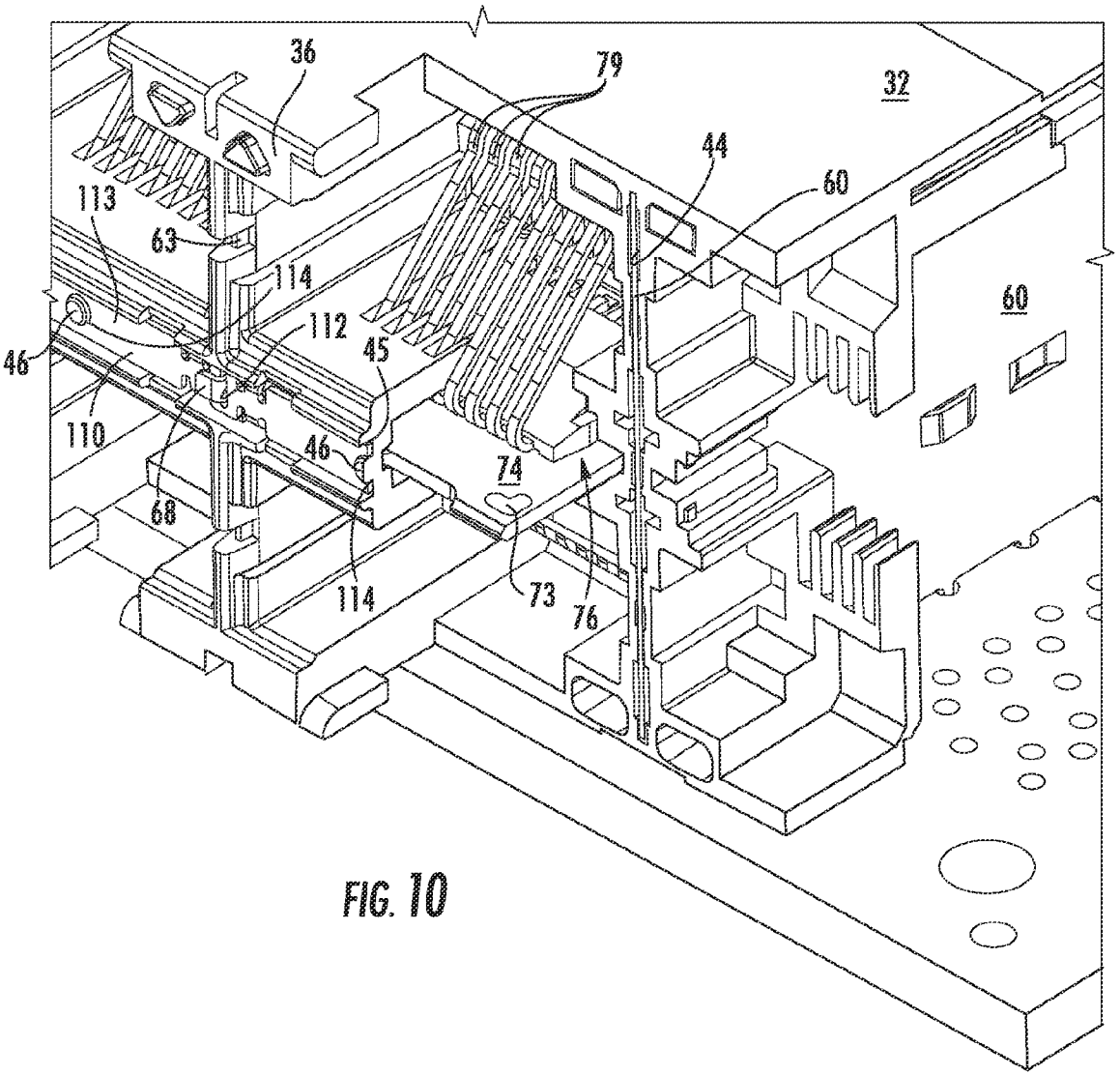
FIG. 10 is an enlarged fragmented perspective view of a portion of FIG. 9.
Figure 11:
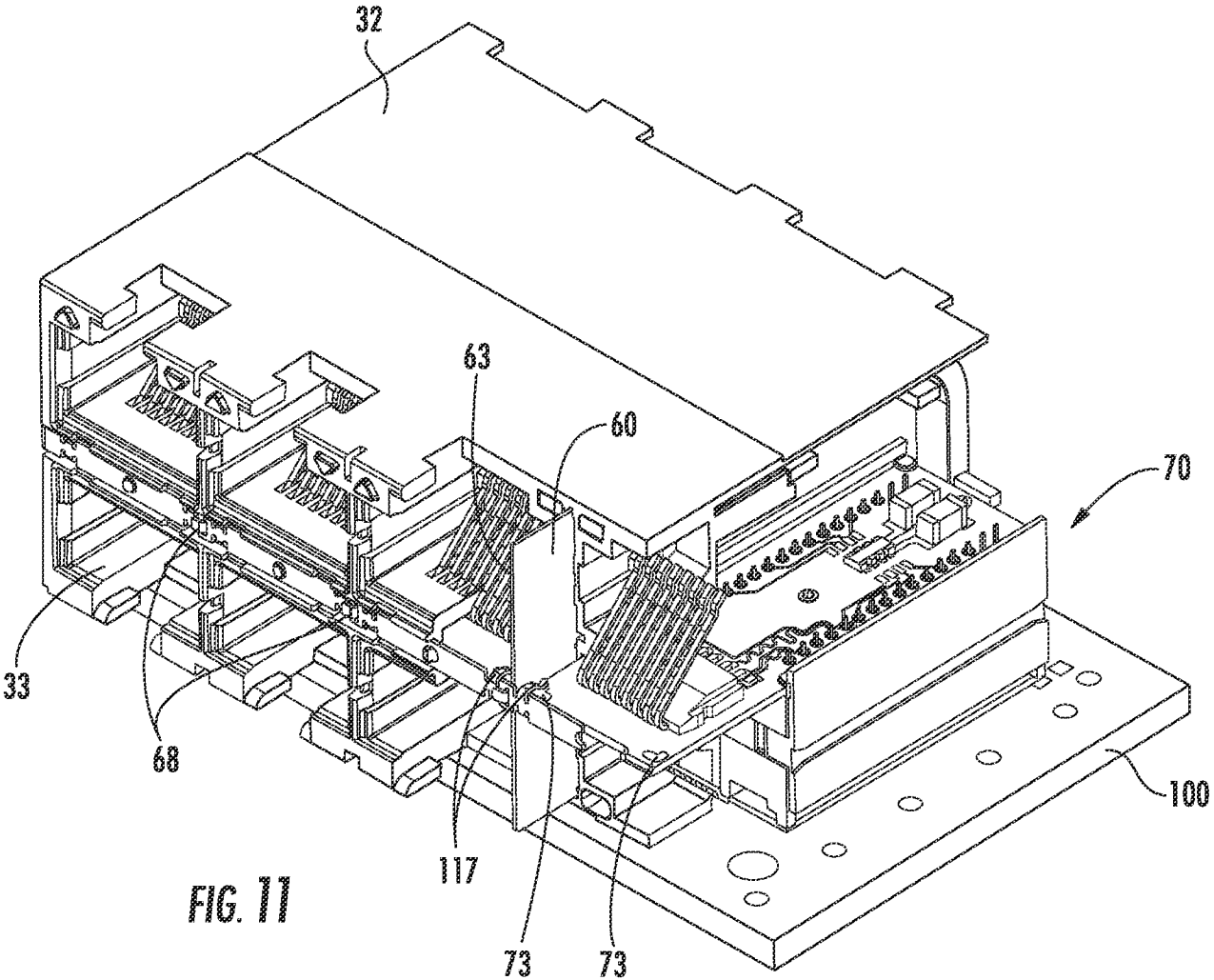
FIG. 11 is a fragmented front perspective view similar to FIG. 9 but with an inter-module shield un-sectioned, an additional internal subassembly module inserted and the shield interconnection clip extended for clarity.

Rear tab 66 extends from the rear edge 67 of each inter-module shield 60 and through slot 69 in rear shield component 53 and then is folded over as best seen in FIG. 3 in order to mechanically and electrically connect inter-module shield 60 to rear shield component 53. Front tab 68 extends from the front edge 63 of each module shield 60 through slot 112 of clip 110 and then is folded over as best seen in FIG. 10 in order to mechanically and electrically connect inter-module shield 60 to clip 110.

Clip 110 is a generally elongated, conductive member that extends along the front face 36 of housing 32 between the upper and lower ports 33 and is configured to mechanically and electrically interconnect various shielding components generally adjacent the front portion of jack 30. More specifically, elongated section 113 of clip 110 includes a plurality of slots 112 corresponding in number to the number of inter-module shields 60 of jack 30 and a plurality of alignment holes 114 located between slots 112 and corresponding in number to the number of vertically aligned pairs of ports 33. Clip 110 is dimensioned to be positioned within a recessed area 45 of the housing in the front face 36 of housing 32 with alignment projections 46 extending from the recessed area 45 into alignment holes 114 in order to property position the clip 110 relative to housing 32.

A pair of vertically aligned, deflectable contact arms 117 are located on opposite sides of each slot 112. Each contact arm is dimensioned and configured to engage one of the conductive ground contact pads 73 located on circuit board 74 of internal subassembly module 70. An enlarged shield engagement section 115 extends around each side wall 37 of housing 32 for engaging front shield 52 once front shield 52 is mounted on the front portion of housing 32. Raised embossments 116 extend outward from engagement sections 115 to provide areas of increased contact pressure in order to create a reliable electrical connection between clip 110 and front shield 52.

Each inter-module shield 60 is secured within magnetic jack 30 on three surfaces. The leading edge 63 is located within vertical slot 44 in housing 32 and tab 68 extends through slot 112 of shield interconnection clip 110. The upper surface of shield 60 is located within channel 41 in upper wall 42 of housing 32 and the rear edge 67 of shield 60 is secured by rear tab 66 that extends through slot 57 in rear shield component 51 Each shield 60 is thus electrically and mechanically connected to rear shield component 53 and is electrically connected to front shield component 52 and each circuit board 74 through clip 110.

As best seen in FIG. 8, inter-module shield 60 fully divides or splits receptacle 34 and extends from front face 36 of housing 32 to the rear edge 39 of housing 32 and from upper wall 42 to the lower mounting surface of housing 32. As a result, each module shield 60 provides vertical shielding between adjacent pairs 33' of upper and lower ports 33 and Ethernet or RJ-45 type plugs (not shown) that are inserted, therein as well as the subassembly modules 70 inserted into subassembly receiving cavities 35.

Figure 12:
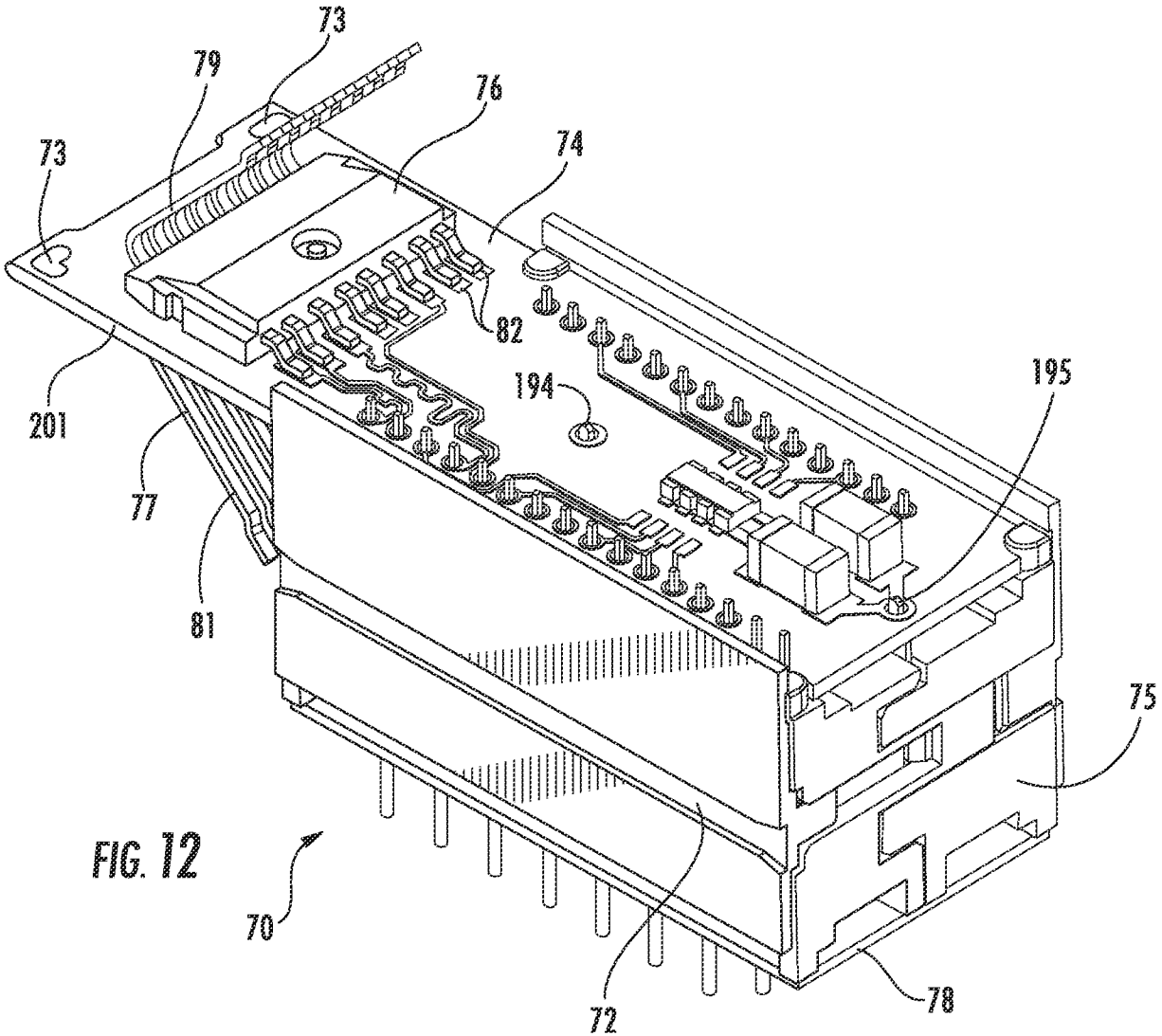
FIG. 12 is a rear perspective view of an internal subassembly module.
Figure 13:
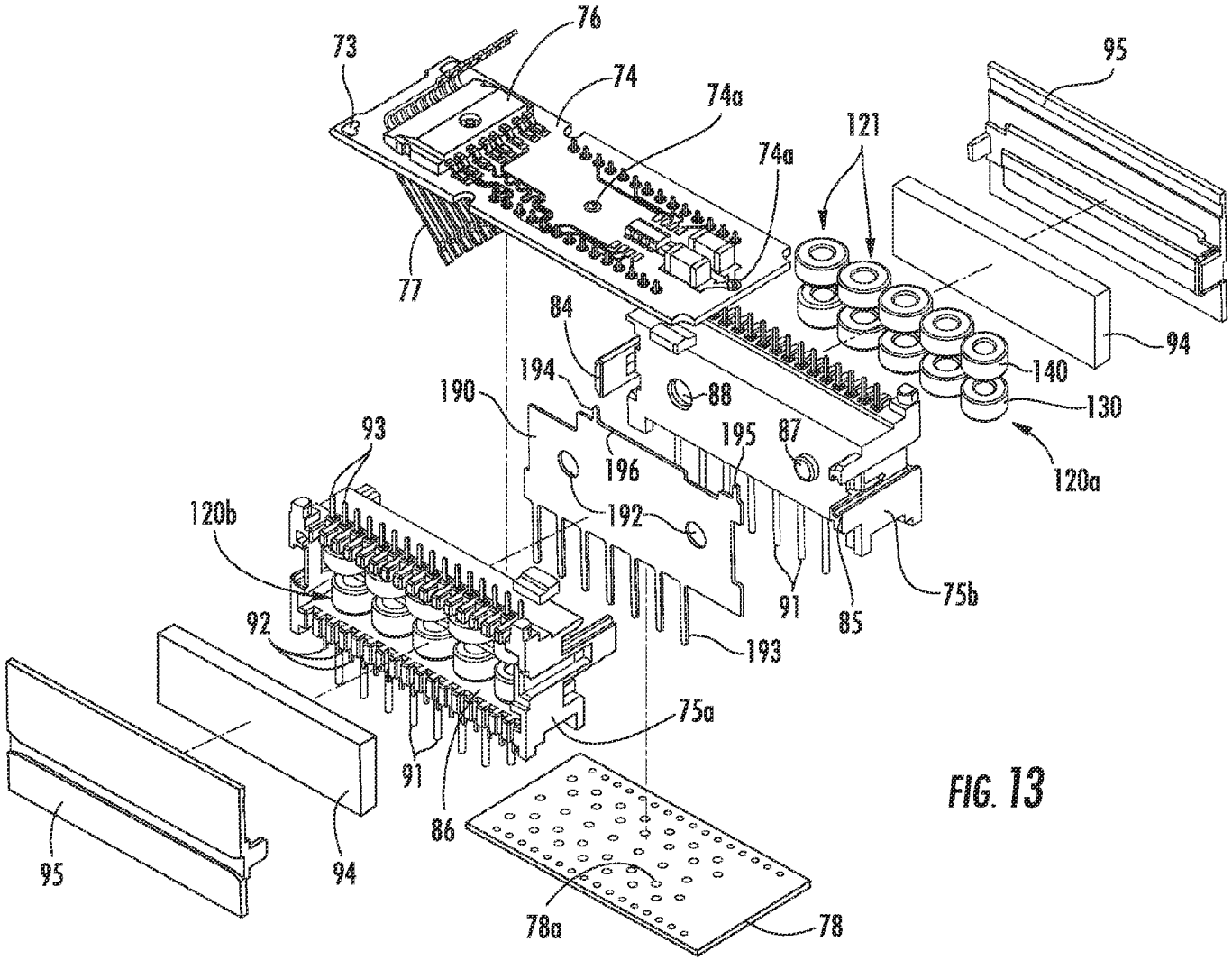
FIG. 13 an exploded perspective view of the internal module of FIG. 12 with the windings removed for clarity.

Referring to FIGS. 12-13, internal subassembly module 70 includes a component housing 75 having transformer circuitry and filtering components therein. An upper circuit board 74 is mounted generally adjacent an upper surface of component housing 75 and includes upper and lower contact assemblies 76, 77 mechanically and electrically connected thereto. Lower circuit board 78 is mounted generally adjacent a lower surface of component housing 75. The upper and lower circuit boards 74, 78 include resistors, capacitors and other components associated with the transformers and chokes located inside the component housing 75.

Subassembly module 70 includes an upper contact assembly 76 and a lower contact assembly 77 for providing a stacked jack, or dual jack, functionality. The upper contact assembly 76 is mounted to an upper surface of upper circuit board 74 and provides physical and electrical interfaces, including upwardly extending contact terminals 79, for connecting to an Ethernet plug inserted within port 33 in the upper row of ports. The lower contact assembly 77 is mounted to a lower surface of upper circuit board 74 and includes downwardly extending electrically conductive contact terminals 81 for connection to an Ethernet plug inserted within a port 33 in the lower row of ports. Upper contact assembly 76 is electrically connected to the upper circuit board 74 through leads, which are soldered, or electrically connected by some other means such as welding or conductive adhesive, to a row of circuit board pads 82 that are positioned along the top surface of upper circuit board 74 generally adjacent a forward edge of component housing 75. Lower contact assembly 77 is similarly mounted on a lower surface of upper circuit board 74 and is connected to second, similar row of circuit board pads (not shown) on a lower surface of upper circuit board 74.

Referring to FIG. 13, component housing 75 is a two-piece assembly having a left housing half 75*a* and right housing half 75*b*, one for holding the magnetics 120*a* of the upper port and the other for holding the magnetics 120*b* of the lower port of each pair of vertically aligned ports. The left and right housings halves 75*a*, 75*b* are formed from a synthetic resin such as LCP or another similar material and may be physically identical for reducing manufacturing costs and simplifying assembly. A latch projection 84 extends from the left sidewall (as viewed in FIG. 13) of each housing half. A latch recess 85 is located in the right sidewall of each housing half and lockingly receives latch projection 84 therein.

Each housing half 75*a*, 75*b* is formed with a large box-like receptacle or opening 86 that receives the filtering magnetics 120 therein. The receptacles 86 of the two housing halves 72*a*, 72*b* face in opposite directions and have an internal elongated shield member 190 positioned between the housing halves. The surface of each housing half facing the elongated shield member 190 includes a projection 87 and a receptacle 88 positioned such that when the two housing halves 72*a*, 72*b* are assembled together, the projection of each housing half will be inserted into the receptacle of the other housing half. The elongated shield member 190 includes a pair of holes 192 aligned with the projections 87 and receptacles 88 such that upon assembling the housing halves 72*a*, 72*b* and shield member 190, each projection 87 will extend through one of the 192 holes and into its receptacle 88 in order to secure shield member 190 in position relative to the housing halves.

A first set of electrically conductive pins or tails 91 extend out of the lower surface of the housing halves 75*a*, 75*b* and are inserted through holes 78*a* in the lower circuit board 78 and soldered thereto. Pins 91 are long enough to extend past lower circuit board 78 and are configured to be subsequently inserted into holes (not shown) in circuit board 100 and soldered thereto. A second, shorter set of pins 92 also extend out of the lower surface of the housing halves 75*a*, 75*b*. A third set of electrically conductive pins 93 extend out of the upper surface of housing halves 75*a*, 75*b* and are inserted into holes 74*a* in upper circuit board 74 and soldered thereto.

The magnetics 120 provide impedance matching, signal shaping and conditioning, high voltage isolation and common-mode noise reduction. This is particularly beneficial in Ethernet systems that utilize cables having unshielded twisted pair ("UTP") transmission lines, as these line are more prone to picking up noise than shielded transmission lines. The magnetics help to filter out the noise and provide good signal integrity and electrical isolation. The magnetics include four transformer and choke subassemblies 121 associated with each port 33. The choke is configured to present high impedance to common-mode noise but low impedance for differential-mode signals. A choke is provided for each transmit and receive channel and each choke can be wired directly to the RJ-45 connector.

Referring to FIG. 13, elongated shield member 190 is a generally rectangular plate and includes seven downwardly depending solder tails 193 configured for insertion and soldering in holes 78*a* in lower circuit board 78. Tails 193 are long enough to extend past lower circuit board 78 and are subsequently inserted into holes (not shown) in circuit board 100 and soldered thereto. Two upwardly extending solder tails 194, 195 extend from a top surface or edge 196 of shield member 190 and are configured for insertion and soldering in holes 74*a* in upper circuit board 74. Shield member 190 is configured to shield the transformers 130 and chokes 140 as well as other circuit components of each housing half from those of its adjacent housing half in order to shield the circuitry of the lower port from that of its vertically aligned upper port and to provide a conductive ground or reference path between upper circuit board 74 and lower circuit board 78.

Figure 15:
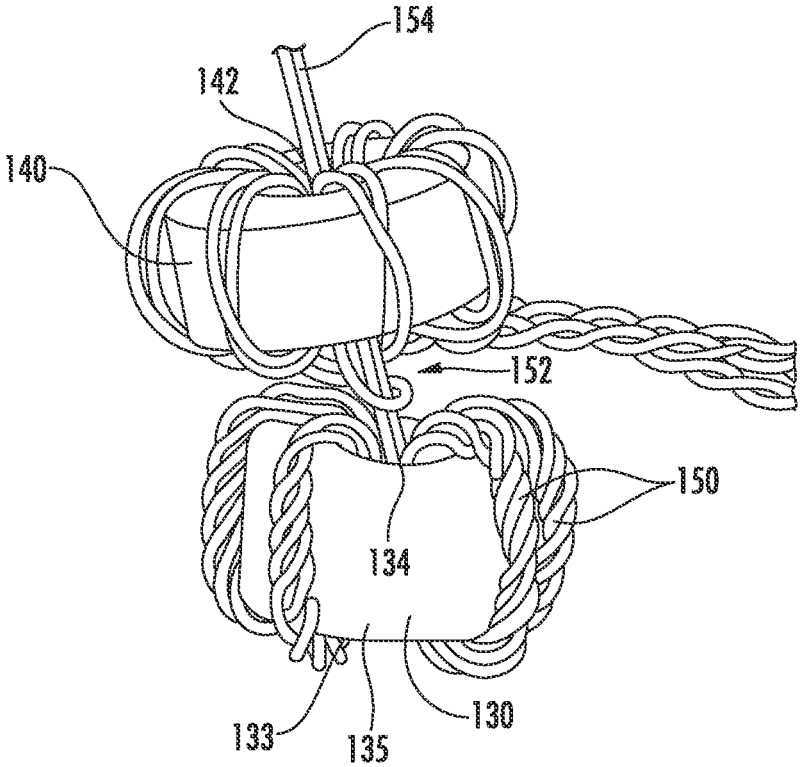
FIG. 15 is a side elevational view of a transformer and choke subassembly that may be used with the disclosed embodiments.

As described above, the magnetics 120 associated with each port 33 of the connector include four transformer and choke subassemblies 121. Referring to FIG. 15, one embodiment of a transformer and choke subassembly 121 can be seen to include a magnetic ferrite transformer core 130, a magnetic ferrite choke core 140, transformer windings 160 and choke windings 170.

Transformer core 130 is toroidal or donut-shaped and may include substantially flat top and bottom surfaces 132, 133, a central bore or opening 134 that defines a smooth, cylindrical inner surface and a smooth, cylindrical outer surface 135. The toroid is symmetrical about a central axis through its central bore 134. Choke core 140 may be similarly shaped. If desired, transformer core 130 and/or choke core 140 may be rectangular, cylindrical, linear, E-shaped or shaped in other manners so long as they operate to efficiently couple the primary and secondary windings.

Figure 14:
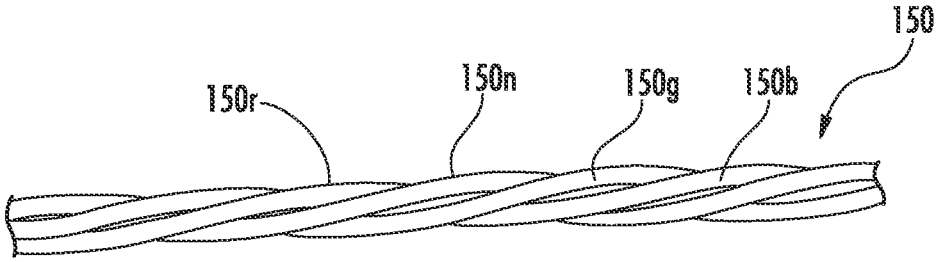
FIG. 14 is a side elevational view of the twisted wires that may be used with the transformer and noise reduction components of the disclosed embodiments.

FIG. 14 illustrates a group of four wires 150 that are initially twisted together and wrapped around the transformer toroid 130. Each of the four wires is covered with a thin, color-coded insulator to aid the assembly process. As depicted herein, the four wires 150 are twisted together in a repeating pattern of a red wire 150*r*, a natural or copper-colored wire 150*n*, a green wire 150*g*, and a blue wire 150*b*. The number of twists per unit length, the diameter of the individual wires, the thickness of the insulation as well as the size and magnetic qualities of the toroids 130 and 140, the number of times the wires are wrapped around the toroids and the dielectric constant of the material surrounding the magnetics are all design factors utilized in order to establish the desired electrical performance of the system magnetics.

As shown in FIG. 15, the four twisted wires 150 are inserted into central bore or opening 134 of toroid 130 and are wrapped around the outer surface 135 of the toroid. The twisted wires 150 are re-threaded through central bore 134 and this process is repeated until the twisted wire group 150 has been threaded through the central bore a predetermined number of times. The ends of the twisted wires adjacent the lower surface 133 of the toroid 130 are bent upward along the outer surface 135 of toroid 130 and wrapped around the other end of the twisted wires to create a single twist 152 that includes all of the wires of the second end wrapped around all of the wires of the first end. The individual wires from the first and second ends are untwisted immediately beyond (or above as viewed in FIG. 15) the single twist 152. One wire from a first end of the group of twisted wires is twisted with a wire from the other end of the group of wires to create twisted wire sections 153. A choke twisted wire section 154 is slid into central opening 142 of choke toroid 140 and looped around the choke toroid the desired number of times. Four transformer and choke assemblies 121 are inserted into each receptacle 86 and the wires are then soldered or otherwise connected to pins 92, 93. A shock absorbing foam insert 94 is then inserted into each receptacle 86 over the transformer and choke assemblies 121 to secure them in place. A cover 95 is secured to each housing half 75*a*, 75*b* to secure foam insert 94 within the respective housing half and to provide shielding to pins 92, 93.

During assembly, module shields 60 are inserted into housing 32 and slid forward (opposite the direction of arrow "A" in FIG. 1) so that the shields are received in channels 41 (FIG. 6) that extend along the inner surface of top wall 39 of housing 32 and into vertical slots 44 (FIGS. 7-9) of the front portion 43 of the housing in order to define a plurality of subassembly receiving cavities 35. A subassembly module 70 is then inserted into each cavity 35 as depicted in FIG. 4 with the channels 72 on the sides of each module engaging the guide rails formed either by projections 64, 65 extending from module shields 60 or projection 38 of the side wall 37 of housing 32.

Figure 2:
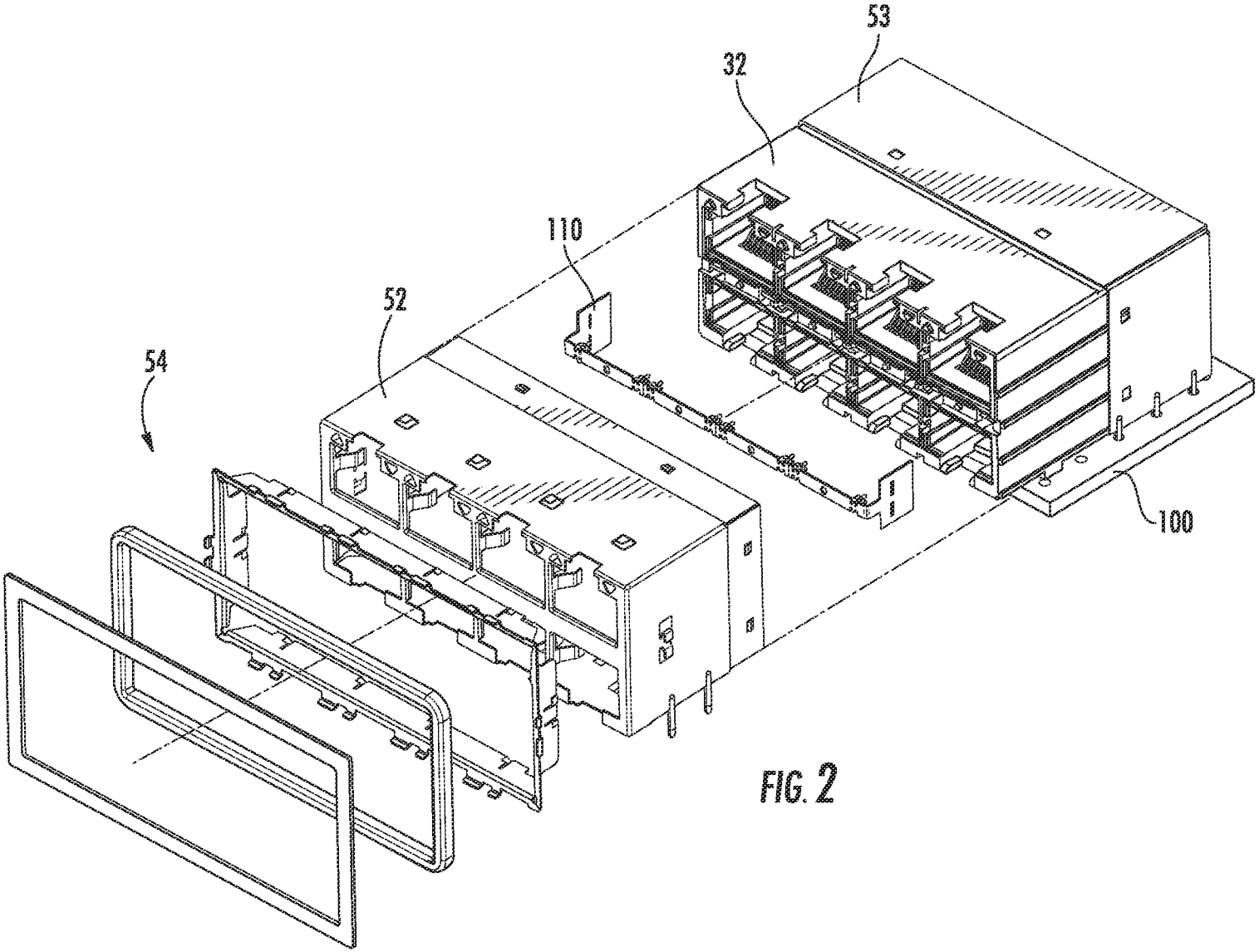
FIG. 2 a partially exploded view of the magnetic jack assembly of FIG. 1 with the front outer shielding and shield interconnection clip removed.

Clip 110 is then slip onto the front surface 36 of housing 32 with projections 46 of housing 32 extending into alignment holes 114 in the clip and with front tabs 68 from each module shield 60 extending into a slot 112 within the clip. Deflectable contact arms 115 slide onto upper circuit board 74 and engage contact pads 73. Front tabs 68 are then bent over to secure tabs 68 to clip 110. Front shield component 52 is then slid onto housing 32 with the inner side surfaces of front shield component 52 engaging raised embossments 116 of enlarged shield engagement section 115 to complete the electrical connection between inter-module shields 60, upper circuit boards 74, clip 110 and front shield 52. Rear shield 53 is then slid and secured onto front shield 52. Rear tab 67 extends from the rear edge of each inter-module shield 60 and through slot 57 in rear shield component 53 and then is folded over as best seen in FIG. 2 in order to secure inter-module shield 60 to rear shield component 53.

With such structure, each inter-module shield 60 is secured within magnetic jack 30 at its leading edge 63 within vertical slot 44 in housing 32, along its upper edge by channel 41 in upper wall 42 of housing 32 and along its rear edge by rear tab 67 that engages rear shield component 53. Module shield 60 fully divides opening 34 and extends from front face 36 of housing 32 to the rear edge of 39 of housing 32 and from upper wall 42 to the lower mounting surface of housing 32. As a result, each module shield 60 provides vertical shielding between adjacent pairs of upper and lower ports 33 and Ethernet or RJ-45 type plugs that are inserted therein as well as the subassembly modules 70 inserted into subassembly receiving cavities 35.

Although the disclosure provided has been described in terms of illustrated embodiments, it is to be understood that the disclosure is not to be interpreted as limiting. Various alterations and modifications will no doubt become apparent to those skilled in the art after having read the above disclosure. For example, the modular jack is depicted as a right angle connector but may also have a vertical orientation. In addition, in some instances, it may be desirable to eliminate the magnetics 120 associated with each module 70 while still utilizing inter-module shields 60 to shield and support the modules 70. Numerous other embodiments, modifications and variations within the scope and spirit of the appended claims will occur to persons of ordinary skill in the art from a review of this disclosure.

The invention claimed is:

1. An electrical connector comprising:

a dielectric housing having a mating face and a plurality of openings therein configured as pairs of first and second aligned openings, each opening being configured to receive a mateable connector therein in a mating direction, the dielectric housing further including a receptacle for receiving a plurality of subassembly modules therein;

a clip with a plurality of electrically conductive contacts supported by the dielectric housing with a portion of each contact extending into the dielectric housing for engaging contacts of a subassembly module upon insertion of the subassembly module into the receptacle;

at least one conductive inter-module shield located within the receptacle and extending generally towards the mating face to define a plurality of module receiving cavities, each cavity being configured to receive an subassembly module therein; and a subassembly module located in at least some of the module receiving cavities, each subassembly module being electrically connected to the contacts of one of the pair of first and second aligned openings.

2. The electrical connector of claim 1, wherein each subassembly module includes a transformer assembly with at least one transformer core having a plurality of wires wrapped therearound.

3. The electrical connector of claim 2, wherein each subassembly module further includes a choke core adjacent the transformer core and some of the plurality of wires wrapped around the transformer core are further wrapped around the choke core.

4. The electrical connector of claim 1, wherein the at least one inter-module shield extends generally from the mating face to an inter-module shield insertion face opposite the mating face in a direction parallel to the mating direction.

5. A modular jack comprising:

a generally rectangular dielectric housing having a mating face, the mating face having a plurality of openings therein configured as pairs of first and second vertically aligned jack openings, each jack opening being configured to receive a mateable connector therein in a mating direction, and a receptacle for receiving a plurality of subassembly modules therein;

a clip positioned on the mating face and support by the housing;

at least one conductive inter-module shield located within the receptacle and extending generally towards the mating face to define a plurality of module receiving cavities, the plurality of module receiving cavities each being configured to receive a subassembly module therein, a portion of the at least one inter-module shield extending between a portion of laterally adjacent jack openings, the at least one conductive inter-module shield electrically connected to the clip; and a plurality of subassembly modules located in at least some of the module receiving cavities, each subassembly module including a plurality of filtering transformers electrically connected to a plurality of electrically conductive contacts with a portion of each contact extending into one of the jack openings for engaging contacts of a mateable connector upon insertion of the mateable connector into one of the jack openings of the dielectric housing.

6. The modular jack of claim 5, wherein the dielectric housing includes front, top, rear and lower surfaces and each inter-module shield extends substantially to the front, top, rear and lower surfaces to vertically shield each module receiving cavity.

7. The modular jack of claim 6, wherein each inter-module shield is generally rectangular and extends generally between the top and lower surfaces of the housing, each jack opening having a rear face to define a depth of the jack opening, and a leading edge of the inter-module shield extends at least halfway between the mating face of the dielectric housing and the rear face of the jack opening.

8. The modular jack of claim 5, wherein the leading edge of each inter-module shield extends generally to the mating face of the dielectric housing.

9. The modular jack of claim 5, further including a shield member substantially surrounding front, side, top and rear surfaces of the housing, each inter-module shield being electrically connected to the shield member adjacent at least one of the surfaces.

10. The modular jack of claim 9, wherein the inter-module shield is electrically connected to the shield member adjacent at least two of the surfaces of the dielectric housing.

11. The modular jack of claim 10, wherein a rear portion of the inter-module shield is mechanically and electrically connected to the shield member adjacent the rear surface of the dielectric housing and a forward portion of the inter-module shield is mechanically and electrically connected to the clip, the clip being electrically and mechanically connected to the shield member.

12. The modular jack of claim 5, wherein the inter-module shield is generally planar with oppositely facing side surfaces and each side surface is configured to engage a complementary shaped outer surface of one of the internal jack modules to assist in the insertion of the internal jack module into one of the module receiving cavities.

13. The modular jack of claim 5, wherein the inter-module shield includes a plurality of tails spaced along a lower surface thereof for interconnection to a circuit member.

14. A modular jack comprising:

a generally rectangular dielectric housing having front, top, rear and lower surfaces and a mating face with a plurality of openings therein, each opening being configured to receive a mateable connector therein in a mating direction, the dielectric housing further including a receptacle;

a plurality of subassembly modules located in the receptacle, each subassembly module having a magnetics assembly and a plurality of electrically conductive contacts, the magnetics assembly including a transformer core having a plurality of conductors, some of the conductors being electrically connected to the electrically conductive contacts, a portion of each electrically conductive contact extending into one of the openings for engaging contacts of a mateable connector upon inserting the mateable connector into one of the openings in the dielectric housing, wherein the rece s tacle is confi ured to receive the plurality of subassembly modules therein; and at least one generally rectangular conductive inter-assembly shield located within the receptacle to define a plurality of subassembly module receiving cavities, the at least one inter-assembly shield having a front portion and a rear portion and extending from generally adjacent the mating face to generally adjacent the rear surface and being interposed between adjacent openings in the mating face and between adjacent subassembly module to electrically isolate contacts within the adjacent openings from each other as well as to electrically isolate the adjacent subassembly modules from each other, wherein each inter-assembly shield is electrically connected to the shield member adjacent at least two of the surfaces of the dielectric housing.

15. The modular jack of claim 14, wherein each inter-assembly shield has a leading edge that extends generally between top and bottom surfaces of the dielectric housing and substantially to the mating face of the dielectric housing.

16. The modular jack of claim 14, wherein the dielectric housing includes front, top, rear and lower surfaces and each inter-assembly shield extends substantially to the front, top, rear and lower surfaces to vertically shield adjacent subassembly modules receiving cavities.

17. The modular jack of claim 14, further comprising a clip electrically and mechanically connected to the shield member, wherein the rear portion of the at least one inter-assembly shield is mechanically and electrically connected to the shield member adjacent the rear surface and the forward portion of each inter-assembly shield is mechanically and electrically connected to the clip.

* * * * *